United States Patent [19]

Schneider

[11] 4,364,506

[45] Dec. 21, 1982

[54] FASTENER DRIVING TOOL WITH CARTRIDGE EJECTOR

[75] Inventor: Fritz Schneider, Burgbernheim, Fed. Rep. of Germany

[73] Assignee: Impex-Essen, Vertrieb von Werkzeugen GmbH, Ansbach, Fed. Rep. of Germany

[21] Appl. No.: 228,378

[22] Filed: Jan. 26, 1981

[30] Foreign Application Priority Data

Jan. 30, 1980 [DE] Fed. Rep. of Germany ..... 3003223

[51] Int. Cl.[3] ..... B25C 1/14

[52] U.S. Cl. ..... 227/10

[58] Field of Search ..... 227/10, 8, 9

[56] References Cited

U.S. PATENT DOCUMENTS 3,168,744 2/1965 Kravle ..... 227/8

3,883,062 5/1975 Jochum ..... 227/9

*Primary Examiner*—Willie G. Abercrombie

*Attorney, Agent, or Firm*—Karl F. Ross

[57] ABSTRACT

A fastener driving tool comprising a tool housing a barrel mounted for axial displacement in the front portion of the housing, a cartridge chamber at the rearward end of the barrel, a breech member positioned within the rear portion of the housing, a cartridge ejector carried by the breech member, an ejector catch on the ejector arranged to engage the rear of the cartridge in the rearwardly displaced ready-to-fire position of the barrel, and a firing pin mounted for displacement within an axial bore through the breech member and arranged to be thrust forward by spring action, prevents rupturing of the cartridge upon firing by using the firing pin itself to prevent any movement of the cartridge ejector at the moment of detonation. The ejector is preferably a plate having a projecting catch and a bore therethrough into which the firing pin penetrates to block lateral movement of the ejector plate.

5 Claims, 1 Drawing Figure

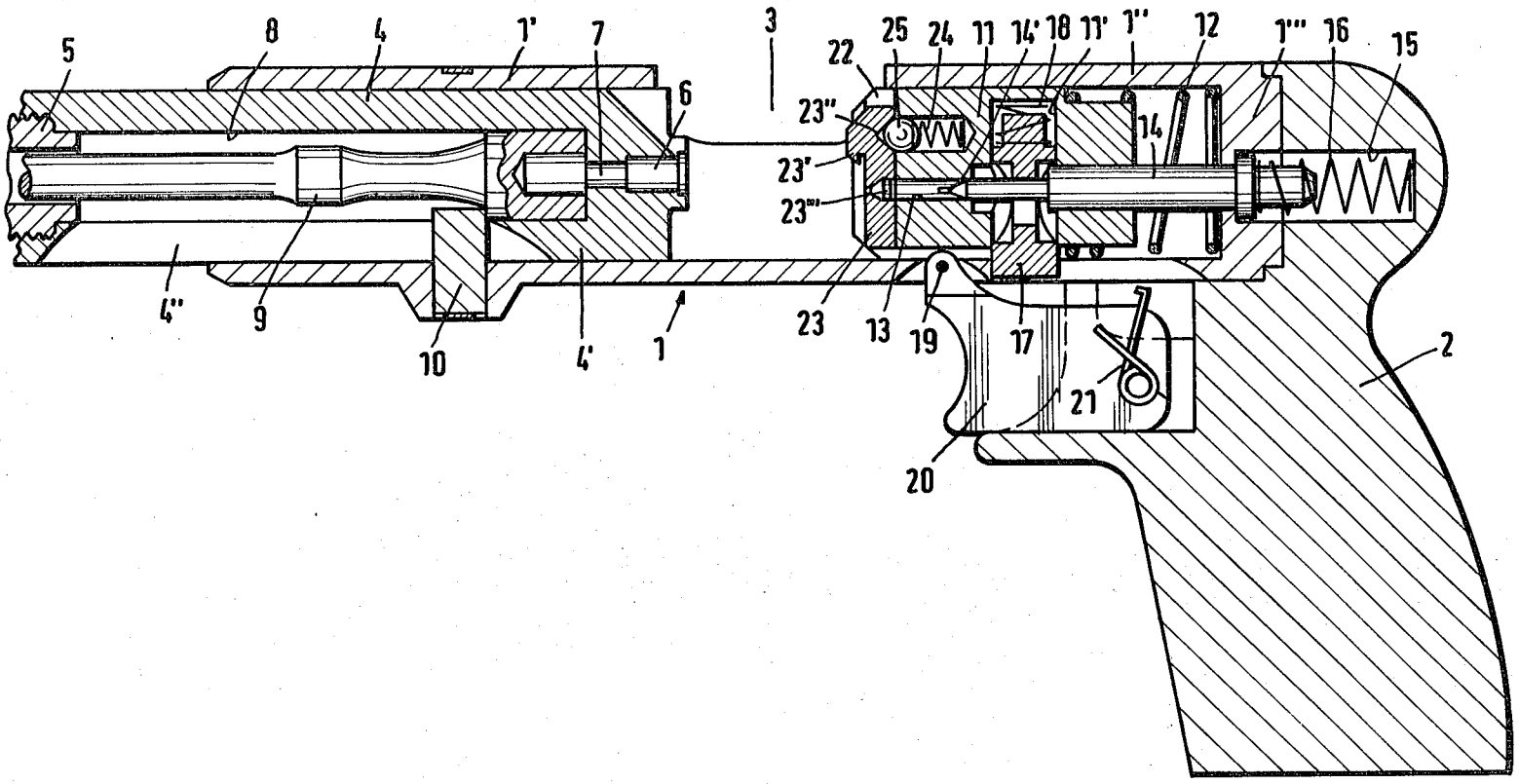
2
15
16
1'''
12
14
1''
11'
18
14'
11
24
25
22
23''
23'
23'''
23
3
13
19
17
21
20
1
6
7
1'
4'
10
4
9
8
4''
5

FASTENER DRIVING TOOL WITH CARTRIDGE EJECTOR

FIELD OF THE INVENTION

This invention relates generally to fastener driving tools. It is particular concerned with such tools which comprise a tool housing, a barrel mounted for axial displacement in the front portion of the housing, a cartridge chamber at the rearward end of the barrel, a breech member positioned within the rear portion of the housing, a cartridge ejector carried by the breech member, an ejector catch on the ejector arranged to engage the rear of the cartridge in the rearwardly displaced ready-to-fire position of the barrel, and a firing pin mounted for displacement within an axial bore through the breech member and arranged to be thrust forward by spring action.

DESCRIPTION OF THE PRIOR ART

In known fastener driving tools of this general type, for example as described in West German published patent application No. 16 03 997 and U.S. Pat. Nos. 2,849,715 and 3,066,302, the cartridge ejector must be able to move sufficiently for its ejector catch to be able to spring over the rear edge of the cartridge when the tool is placed against the fastener-receiving surface and the barrel is subsequently pushed back, in order that the cartridge can be withdrawn from the cartridge chamber upon the subsequent forward movement of the barrel. The cartridge ejector is therefore supported for spring-controlled movement against the tool housing or in the breech member and is mounted with the necessary freedom for axial as well as radial movement. Because of this freedom of movement and the consequent flexibility of the cartridge ejector, the cartridge can expand or deform when detonated in this position, so that there is the danger of the cartridge rupturing. This occurs, even if only to a limited degree, if the cartridge ejector, as is the case in U.S. Pat. No. 3,066,302, in the ready-to-fire position, is forced by the thus retracted barrel against a radially outward restraining shoulder defined by the tool housing and is held there. Moreover, in that arrangement, the cartridge ejector has a comparatively complex and delicate construction and the barrel must be supported at its end against the tool housing by means of a special recoil spring in order to achieve a sufficient safety factor for the tool on account of the fact that the ejector catch here normally projects out far beyond the breech member.

SUMMARY OF THE INVENTION

It is an object of the present invention to provide a fastener driving tool of the type first referred to above in which, in spite of the fact that the cartridge ejector is capable of limited movement, no rupturing of the cartridge of any sort can take place.

This object is achieved in accordance with the invention in an extraordinarily simple way, in that the cartridge ejector is capable of limited displacement transversely to the longitudinal axis of the cartridge chamber but in its cartridge-gripping position is prevented from moving relative to the breech member by the firing pin.

In this way every possibility of deflection movement of the cartridge ejector at the moment of detonation of the cartridge is thus prevented, so that the base of the cartridge thus remains supported in a trouble-free manner in its most endangered region where it is gripped by the ejector catch, and consequently rupture of the cartridge cannot occur here.

It is particularly advantageous if the cartridge ejector comprises an ejector plate which carries a forwardly projecting ejector catch and which is mounted for transverse displacement against a spring force on the front end face of the breech member, with the ejector plate having a firing bore therethrough which is aligned with the axial bore in the breech member in the ready-to-fire position and which is arranged to be penetrated by the tip of the advancing firing pin. By this means the ejector plate which supports the base of the cartridge over a wide area in the ready-to-fire position can be reliably and simply prevented from moving just by the firing pin advancing to cause the detonation, without any additional means having to be provided for this purpose.

The ejector plate is preferably guided in a T-shaped groove in the breech member and is provided at its rear with a latching recess in which a spring-biassed latching ball mounted at the front end face of the breech member engages, with the latching ball attempting to hold the ejector plate in its normal latching position on the breech member corresponding to the ready-to-fire position.

The breech member provided with the displaceable ejector plate is preferably mounted in the rear portion of the tool housing in a manner known per se so as to be displaceable against the action of a recoil spring, and is provided with a transversely displaceable blocking member for the cocking and release of the firing pin, the blocking member being actuated by trigger means. By this means not only is the cartridge-breech interface displaced upon detonation into the safest region of the rear portion of the tool housing, but additionally one achieves the required adequate safety of the tool.

The blocking of the cartridge ejector, which is capable of limited movement, during the detonation of the cartridge can be applied basically to all fastener driving tools of the type in question, and also to fastener driving tools arranged to drive in fasteners subject to the direct action of combustion gases from the detonated cartridge. However, it is more advantageous if the fastener driving tool of the invention is designed as a driving ram tool with a manually displaceable barrel, with the cartridge chamber at the rear of the barrel being connected by way of a comparatively narrow gas bore with a larger diameter bore within the barrel which contains the driving ram, and in which the driving ram thrown forward after the driving in of a fastener is displaced by forward movement of the barrel, by means of a reset pin projecting through a longitudinal slot in the barrel and fixed in the forward part of the tool housing, into its ready-to-drive position at the rear of the barrel. Since with driving ram fastener driving tools of this type the barrel containing the driving ram remains in the rearwardly displaced position after the detonation of the cartridge, in which position the catch of the cartridge ejector grips the rim of the cartridge base, the cartridge sleeve is extracted reliably from the cartridge chamber at the end of the barrel after the tool has been lifted away from the fastener-receiving surface and after appropriate manual forward movement of the barrel relative to the tool housing.

DESCRIPTION OF THE PREFERRED EMBODIMENT

In order that the invention may be fully understood there now follows a description of a preferred embodiment of a fastener driving tool according to the invention, the description being given by way of example and with reference to the accompanying drawing which is a sectional view through the tool.

The assembled fastener driving tool comprises a substantially cylindrical tool housing 1 with a front housing portion 1' and a rear housing portion 1'', the housing being screwed securely on to a hand-grip member 2 in a manner which is not shown in detail. Between the two housing portions 1', 1'' a window opening 3 is provided in the housing 1 which serves for the loading of the cartridge and the ejection of the spent cartridge case.

A barrel 4, which carries a muzzle-piece 5 screwed into its front end, is mounted in the front portion 1' of the tool housing so as to be axially displaceable. No recoil spring is provided. At the rear end 4' of the barrel 4 there is a cartridge chamber 6. This cartridge chamber 6 is connected by way of a comparatively narrow gas-constraining bore 7 with a substantially larger diameter bore 8 which is provided within the barrel 4 and in which a driving ram 9 is mounted for axial displacement. By means of the driving ram 9 a fastener (not shown) inserted into the muzzle-piece 5 is driven into a wall, floor or other receiving surface following the detonation of a cartridge inserted into the cartridge chamber 6. The term "fastener" when used herein is intended to include bolts, studs, pins, screws, rivets, etcetera. Furthermore, within the front portion 1' of the tool housing there is positioned a reset pin 10 which projects inwardly through a longitudinal slot 4'' provided in the barrel 4 and which in known manner permits the driving ram 9 to be displaced by a preparatory manual movement back into the illustrated rearward ready-to-drive position in the barrel 4 after the ram has previously moved forward in the barrel 4 as a result of its forward driving movement.

Within the rear portion 1'' of the housing a breech member 11 is axially displaceably housed and is supported against the rear end 1''' of the tool housing by means of a recoil spring 12. Within the breech member 11 there is a through-going stepped axial bore 13 for a firing pin 14 which is correspondingly stepped in diameter and which at its rear end is subjected to the force of a firing spring 16 housed within a bore 15 recessed into the handgrip member 2. Also within the breech member 11 there is a blocking member 17 which is mounted in an appropriate transverse bore 11' for limited displacement therein. The blocking member 17 is subject to the action of a compression spring 18 which urges the blocking member outwardly into a position in which it blocks forward movement of the firing pin 14, in which position the pin is cocked. Inward movement of the blocking member 17 causes the firing pin 14 to become free to travel forward. For this purpose the blocking member 17 co-operates in known manner with and is displaced inwardly by a trigger lever 20 which is hingedly connected to the tool housing at a point 19. The trigger lever 20 is provided with a hooped double-armed spring 21 which biasses the trigger 20 into its illustrated normal position.

At the front end face of the breech member 11 there is provided a vertically extending T-shaped groove 22 in which a cartridge ejector plate 23 provided with a forwardly projecting ejector catch 23' is displaceably mounted. This ejector plate 23 is provided at the rear with a conical recess 23'' in which a latching ball 25 which is subject to the biassing action of a spring 24 and which is positioned within the front face of the breech member 11 engages. In this way the ejector plate 23 is held in its normal illustrated latching position on the breech member 11, this position corresponding to the ready-to-fire position. Furthermore, there is provided through the ejector plate 23 a conical firing bore 23''' which in the illustrated ready-to-fire position of the ejector plate 23 is aligned with the axial bore 13 in the breech member 11 for the firing pin 14. The firing bore 23''' in the ejector plate is penetrated by the tip 14' of the advancing firing pin 14 as it travels forward to detonate the cartridge, so that the cartridge ejector plate 23 is thereby completely prevented from moving and cannot even be displaced laterally.

In use, after the fitting of a fastener into the muzzle-piece 5 and the loading of a cartridge into the cartridge chamber 6, the muzzle-piece 5 of the fastener driving tool is pressed against the surface into which the fastener is to be driven, with the result that the barrel 4 is displaced backwards into the tool housing 1'. As a result of this the rim of the loaded cartridge strikes against the catch 23' on the ejector plate 23 which thereby performs a short-stroke transverse displacement movement, overcoming the influence of the spring-controlled latching ball 25, so that the catch 23' snaps over the rim of the cartridge and the ejector plate 23 then returns again to its normal latching position as illustrated. Upon further rearward pressure on the barrel 4, the breech member 11 is displaced backwards against the force of its recoil spring 12, with the result that the firing pin 14 is entrained by the blocking member 17 and the firing spring 16 is thereby correspondingly cocked. When the rearward ready-to-fire position of the movable parts of the tool is reached, then the blocking member 17 can be pushed in by actuation of the trigger 20, with the result that the firing pin 14 is thrust forward. Even before its tip 14' actually causes the firing of the cartridge, the ejector plate 23 is prevented from lateral displacement by virtue of the firing pin tip travelling into the ejector plate bore 23''', so that at the instant of detonation the ejector plate 23 cannot be displaced laterally and tearing or rupturing of the cartridge sleeve is thus avoided. The power combustion gases which form as a result of the detonation cause the driving ram 9 to be forced forwards, thus driving the fastener into the receiving surface, while the barrel 4 at first still remains in its rearward position. When the fastener driving tool is subsequently lifted away from the receiving surface, then the breech member 11 is moved back to its illustrated starting position by the recoil spring 12, and in addition the barrel 4 is displaced forwards by a corresponding amount within the tool housing 1'. After this, by pulling the barrel 4 further out of the tool housing 1' by hand, the spent cartridge is withdrawn from the cartridge chamber 6 by means of the ejector plate 23 and the action of its catch 23', and, additionally, the driving ram 9 is brought to its rearward starting position in the barrel 4 behind the reset pin 10.

I claim:

1. A fastener driving tool comprising a housing, a barrel mounted to be axially displaceable in the front portion of the housing, a cartridge chamber at the rearward end of the barrel, a breech member positioned within the rear portion of the tool housing, a cartridge ejector carried by the breech member, an ejector catch on the ejector arranged to engage the rear of the cartridge in the rearwardly displaced ready-to-fire position of the barrel, and a firing pin mounted to be displaceable within an axial bore through the breech member and arranged to be thrust forward by spring action, means mounting the cartridge ejector for limited displacement transversely to the longitudinal axis of the cartridge chamber but whereby the cartridge in its cartridge-gripping position is prevented from moving relative to the breech member by the firing pin.

2. A fastener-driving tool according to claim 1, in which the cartridge ejector comprises an ejector plate which carries a forwardly projecting catch and which is mounted for transverse displacement against a spring force on the front end face of the breech member, the ejector plate being provided with a firing bore therethrough which is aligned with the axial bore in the breech member in the ready-to-fire position and which is arranged to be penetrated by the tip of the advancing firing pin.

3. A fastener driving tool according to claim 2, in which the ejector plate is guided in a T-shaped groove in the breech member and is provided at its rear with a latching recess in which a spring-biassed latching ball mounted at the front end face of the breech member engages, said latching ball biassing the ejector plate into its normal latching position on the breech member corresponding to the ready-to-fire position.

4. A fastener driving tool according to claim 1, in which the breech member provided at its front end with the transversely displaceable ejector is axially displaceably mounted within the rear portion of the tool housing against the action of a recoil spring, and in which the breech member is provided with a transversely displaceable blocking member for the cocking and release of the firing pin, said blocking member being actuated by trigger means.

5. A fastener driving tool according to claim 1, formed as a driving ram tool with a barrel which is displaceable manually, the cartridge chamber at the rear of the barrel being connected by means of a comparatively narrow gas bore with a larger diameter bore within the barrel which contains a driving ram, and in which the driving ram thrown forward after the driving in of a fastener is displaced by forward movement of the barrel by means of a reset pin projecting through a longitudinal slot in the barrel and fixed in the forward part of the tool housing, into its ready-to-drive position at the rear of the barrel.

* * * * *